US007855517B2

(12) United States Patent
Turpin et al.

(10) Patent No.: US 7,855,517 B2
(45) Date of Patent: Dec. 21, 2010

(54) CURRENT DRIVER CIRCUIT AND METHOD OF OPERATION THEREFOR

(75) Inventors: Pierre Turpin, Toulouse (FR); Laurent Guillot, Seysses (FR)

(73) Assignee: Freescale Semiconductor, Inc., Austin, TX (US)

( * ) Notice: Subject to any disclaimer, the term of this patent is extended or adjusted under 35 U.S.C. 154(b) by 326 days.

(21) Appl. No.: 11/911,805

(22) PCT Filed: Apr. 18, 2005

(86) PCT No.: PCT/EP2005/005211

§ 371 (c)(1),
(2), (4) Date: Oct. 17, 2007

(87) PCT Pub. No.: WO2006/111187

PCT Pub. Date: Oct. 26, 2006

(65) Prior Publication Data

US 2008/0203942 A1 Aug. 28, 2008

(51) Int. Cl.
*H05B 41/36* (2006.01)

(52) U.S. Cl. ..... 315/224; 315/291; 315/307

(58) Field of Classification Search ..... 315/291, 315/224; 361/1, 18, 22, 88–91.3, 93.1, 93.2, 361/93.4, 93.7–93.9, 94
See application file for complete search history.

(56) References Cited

U.S. PATENT DOCUMENTS

| | | | | |
|---|---|---|---|---|
| 4,851,953 | A | 7/1989 | O'Neill et al. | |
| 4,967,304 | A | 10/1990 | Dougherty | |
| 5,512,883 | A | 4/1996 | Lane, Jr. | |
| 5,821,703 | A | 10/1998 | Callahan et al. | |
| 6,414,860 | B1 | 7/2002 | Li | |
| 6,531,830 | B2 * | 3/2003 | Akimoto et al. | 315/224 |
| 2003/0095368 | A1 | 5/2003 | Daniels et al. | |
| 2003/0156374 | A1 | 8/2003 | Edwards et al. | |
| 2004/0125245 | A1 * | 7/2004 | Choi | 349/1 |
| 2006/0049780 | A1 * | 3/2006 | Hsieh | 315/291 |
| 2008/0204957 | A1 * | 8/2008 | Turpin et al. | 361/93.9 |

FOREIGN PATENT DOCUMENTS

| | | | |
|---|---|---|---|
| EP | 0340762 | A2 | 11/1989 |
| EP | 0659307 | | 5/1996 |
| GB | 2230664 | A | 10/1990 |
| WO | 9925049 | A1 | 5/1999 |

* cited by examiner

*Primary Examiner*—Douglas W Owens
*Assistant Examiner*—Jianzi Chen

(57) ABSTRACT

A current driver circuit comprises a digital circuitry having a current adjustment function and operably coupled to a current driver for providing a current to a current consuming device. The digital circuitry comprises, or is operably coupled to, a function arranged to determine a load impedance associated with the current consuming device. The current adjustment function varies a current limit applied to the current driver in response to a variation in the load impedance.

In this manner, the load impedance (or temperature) of a current consuming device, such as a light bulb, is used to continuously or intermittently adjusting the current limit of a current driver circuit, such as a lamp driver, to minimize the energy dissipated in case of an overload condition.

15 Claims, 5 Drawing Sheets

FIG. 1 - Prior art
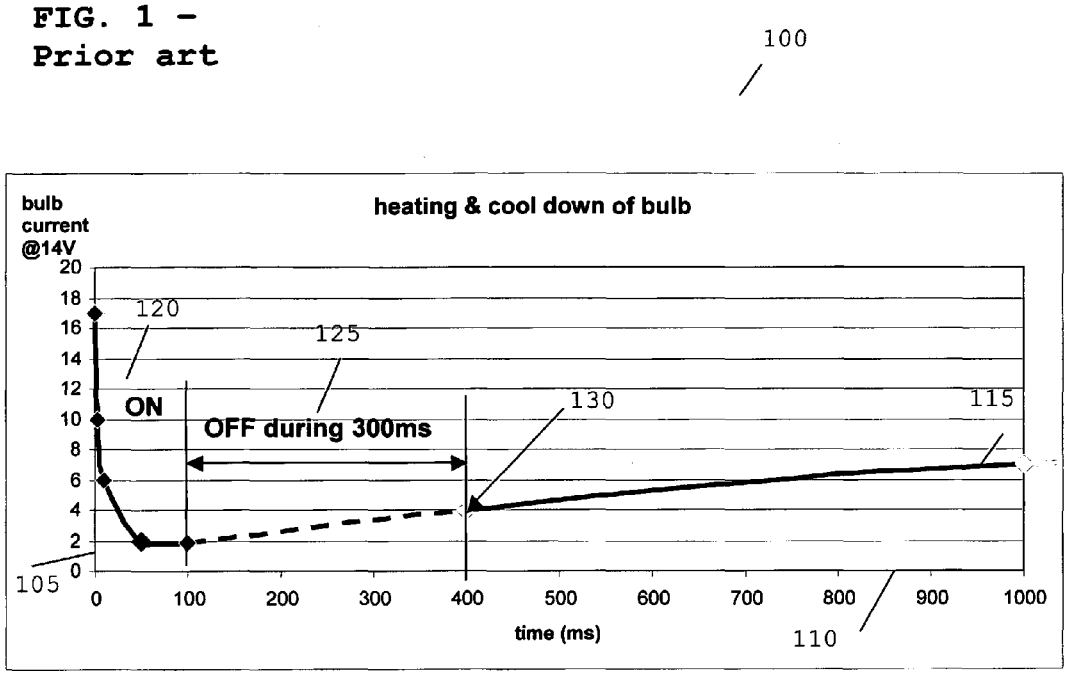
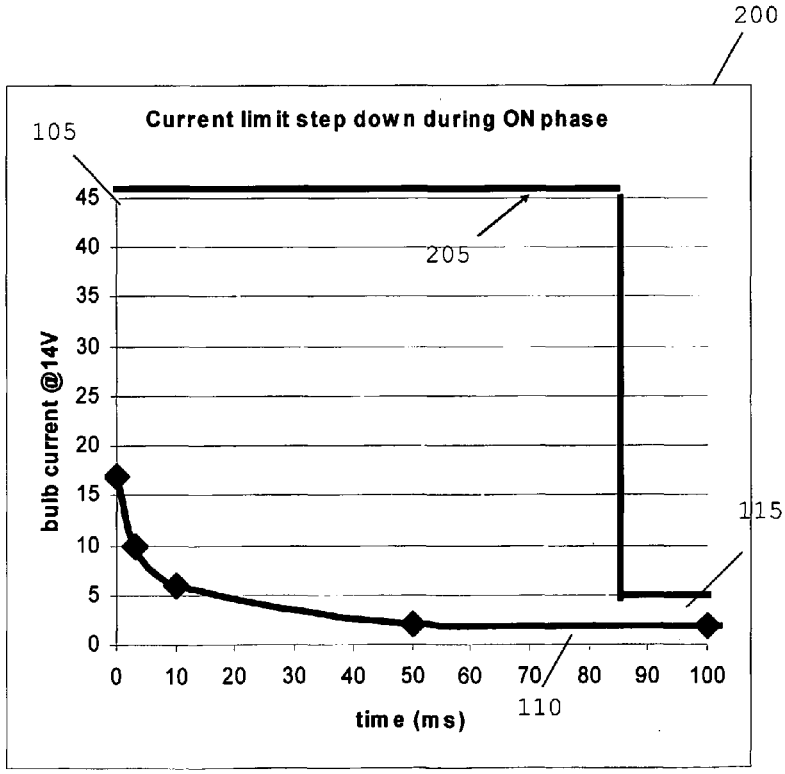
FIG. 2 - Prior art

500

CURRENT DRIVER CIRCUIT AND METHOD OF OPERATION THEREFOR

FIELD OF THE INVENTION

The preferred embodiment of the present invention relates to current drivers suitable for use as lamp drivers. The invention is applicable to, but not limited to, current drivers required to support high (inrush) current to a light bulb at a point of 'turn-ON'.

BACKGROUND OF THE INVENTION

In the field of semiconductor devices, there has been an increasing interest in the development of more intelligence based within the device, often referred to as 'smart' devices. The terminology used for 'smart' devices encompasses the association of analogue and digital circuitry with precise diagnosis. It is also generally desired to implement more intelligent features in the provision of smart high-power devices, in order to improve reliability and longevity of the device, which is known as problematic due to the increased stresses applicable with high power operation. One such smart high-power device is a lamp driver. In the context of the present invention, the term 'lamp driver' encompasses a driver circuit for filament lamps.

All known lamp driver integrated circuits (ICs), such as an MC33892 switch from Freescale™, etc. require the ability to support a high current upon switch 'ON' of the lamp. In this regard, and referring first to FIG. 1, a known process of a bulb heating up and cooling down is illustrated graphically 100. The graph 100 illustrates how a bulb current (in Amps (A)) 105 varies 115 versus time (in msec) 110. The bulb is initially illustrated as being turned 'ON', where the 'turn-On' current reaches a peak current of approximately 17 A. The bulb is left in an 'ON' state for approximately 100 msec's 120, during which time the current requirements drop to a dc current value of around 2 A, and then the bulb is turned 'OFF' 130. Notably, if the bulb is then turned 'ON' again 125, after say an 'OFF' period of 300 msec's, the bulb only draws 4 A.

However, the inventors of the present invention have recognised that even though the 'bulb' current drops from, say 17 A to 2 A in around 50 msec., a standard lamp driver requires a high current of (maximum) 45 A upon turn 'ON', which is maintained for say a maximum period of 80 msec. when it is stepped down to, say 5 A. This lamp driver current requirement 215 is illustrated graphically 200 in FIG. 2.

Similarly, if the bulb is turned 'OFF', the current limitation is reset and will be kept at a high level of 45 A again until the next turn 'ON' operation. Such high currents are very undesirable and significantly shorten the average life span of the lamp driver device.

It is known that some applications may employ pulse width modulation (PWM), where the cyclical current requirements may be set through a serial port interface (SPI). Employing a PWM mode of operation facilitates a significant reduction in the average current requirements of a lamp driver circuit. Here, PWM may be employed at a rate, say, of typically 200 Hz, and applied after the initial 45 A inrush current.

However, in implementing a PWM scheme, a digital circuit is required and configured to control the lamp driver in a real time manner. In this regard, the digital circuit provides control signals to the lamp driver, say 80 msec after the start of PWM period. Alternatively, the lamp driver needs to be configured to perform the PWM operation, which adds to the complexity.

Notably, such circuits cannot be employed with low PWM rates, such as a PWM at around 1 Hz that would be suitable for flasher application or for reliability testing with cyclic short circuits, again at around 1 Hz.

The inventors have recognised and appreciated a further problem with lamp driver ICs, in that they are prone to cyclical short circuits, for example a permanent or erratic short circuit with repetitive turn-'ON'. In this regard, the lamp driver circuit has no 'memory' of a previous PWM cycle, i.e. the current limit is reset at every turn 'OFF'. Hence, known lamp driver circuits assume that the bulb is always cold (i.e. the motor has stopped or an inductance has been charged), and consequently they draw 45 A as a prerequisite upon switch 'ON'.

In known lamp driver applications, it is also known that the current limit of a lamp driver power stage comprises two levels, one for the peak current and one for the dc level. Furthermore, this current limit is set to support the worst case current loads required by the lamp. Also, the current limit imposed on the driver current needs to be able to support an inrush current at each turn 'ON' of the lamp.

Furthermore, in a case of a 'true' short circuit, the device will potentially drive a high amount of current into the lamp at each turn 'ON'. This situation creates high levels of stress in the IC package, thereby reducing the lifetime of the device.

Thus, a need exists for an improved current driver, such as one suitable as a lamp driver and bulb arrangement and method of operation therefor.

STATEMENT OF INVENTION

In accordance with aspects of the present invention, there is provided a current driver circuit, such as a lamp driver and bulb arrangement, and method of operation therefor, as defined in the appended Claims.

BRIEF DESCRIPTION OF THE DRAWINGS

FIG. 1 and FIG. 2 illustrate graphically a known operation of a lamp driver circuit and bulb, with regard to current requirements over time.

Figure 3:
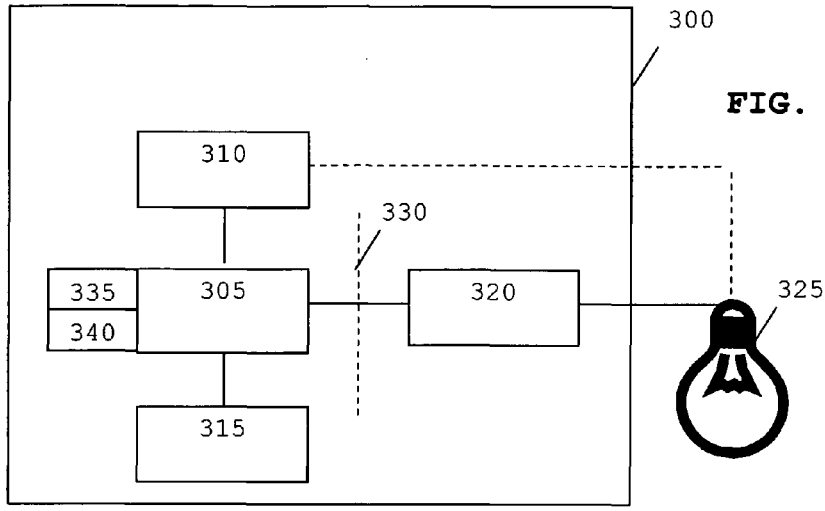
Figure 4:
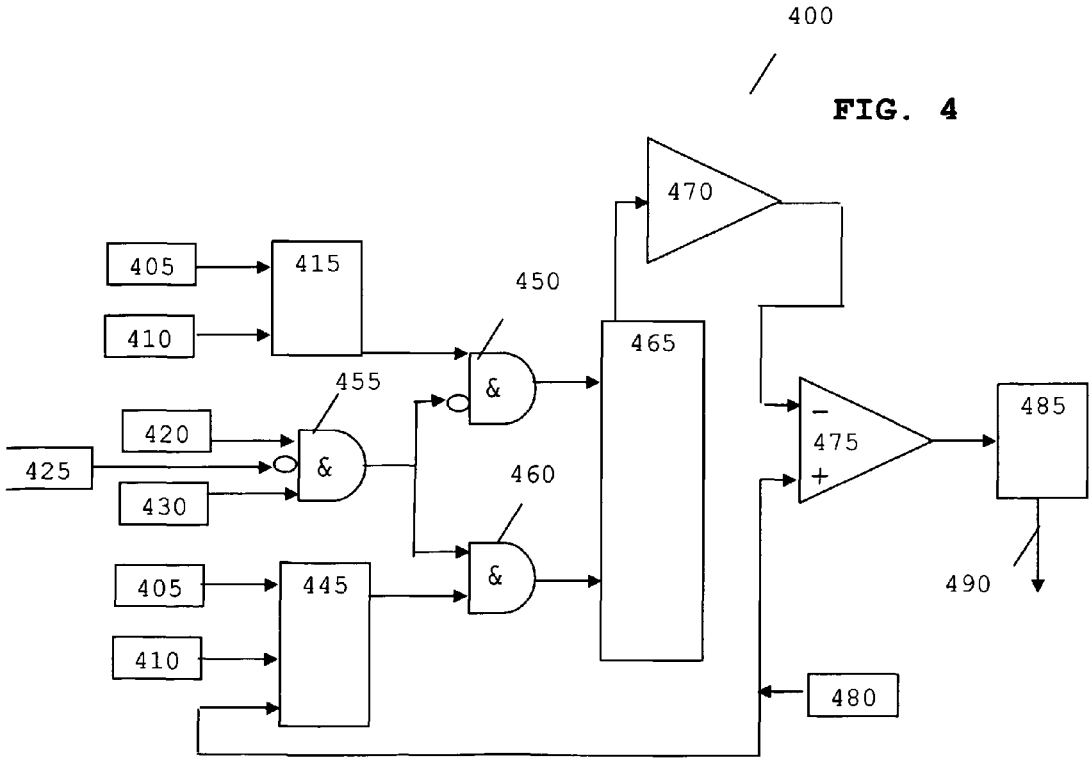
Figure 5:
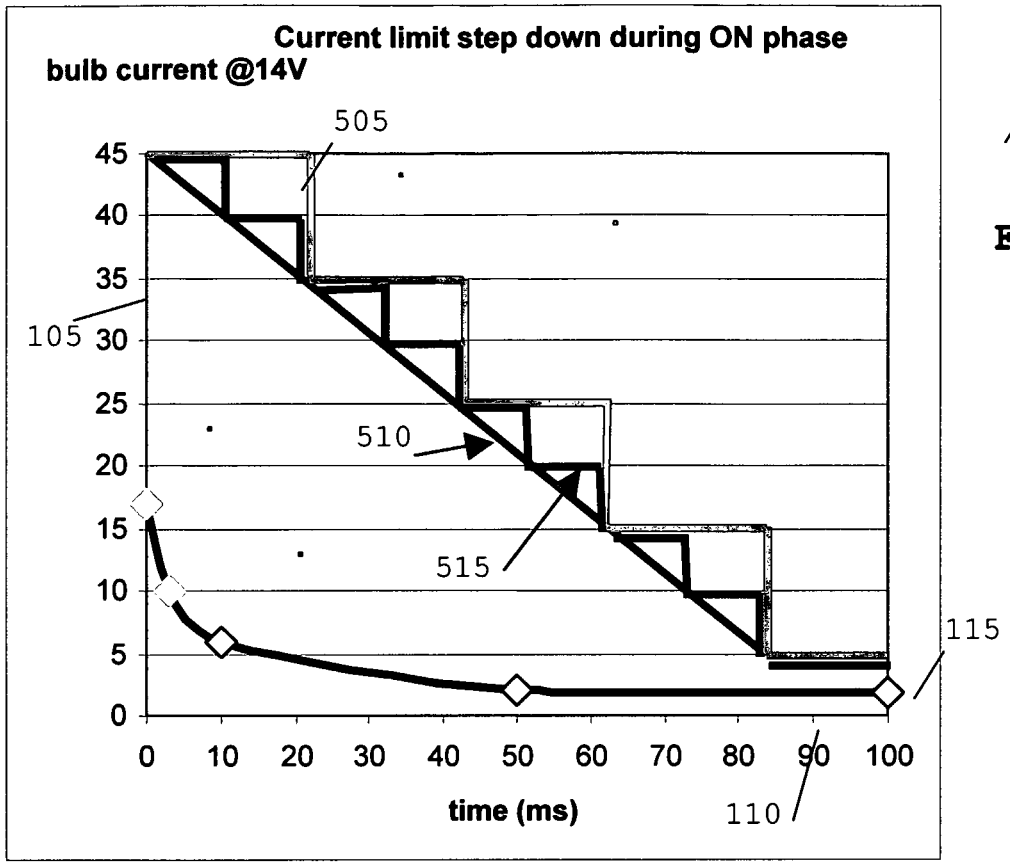
Figure 6:
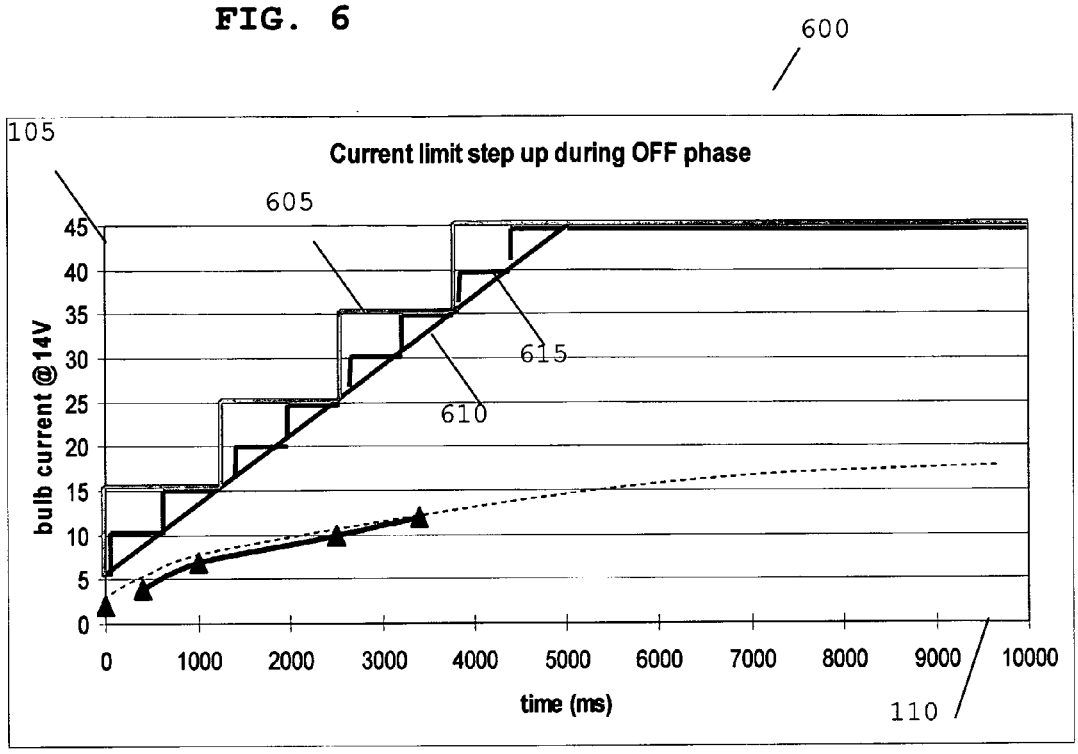
Figure 7:
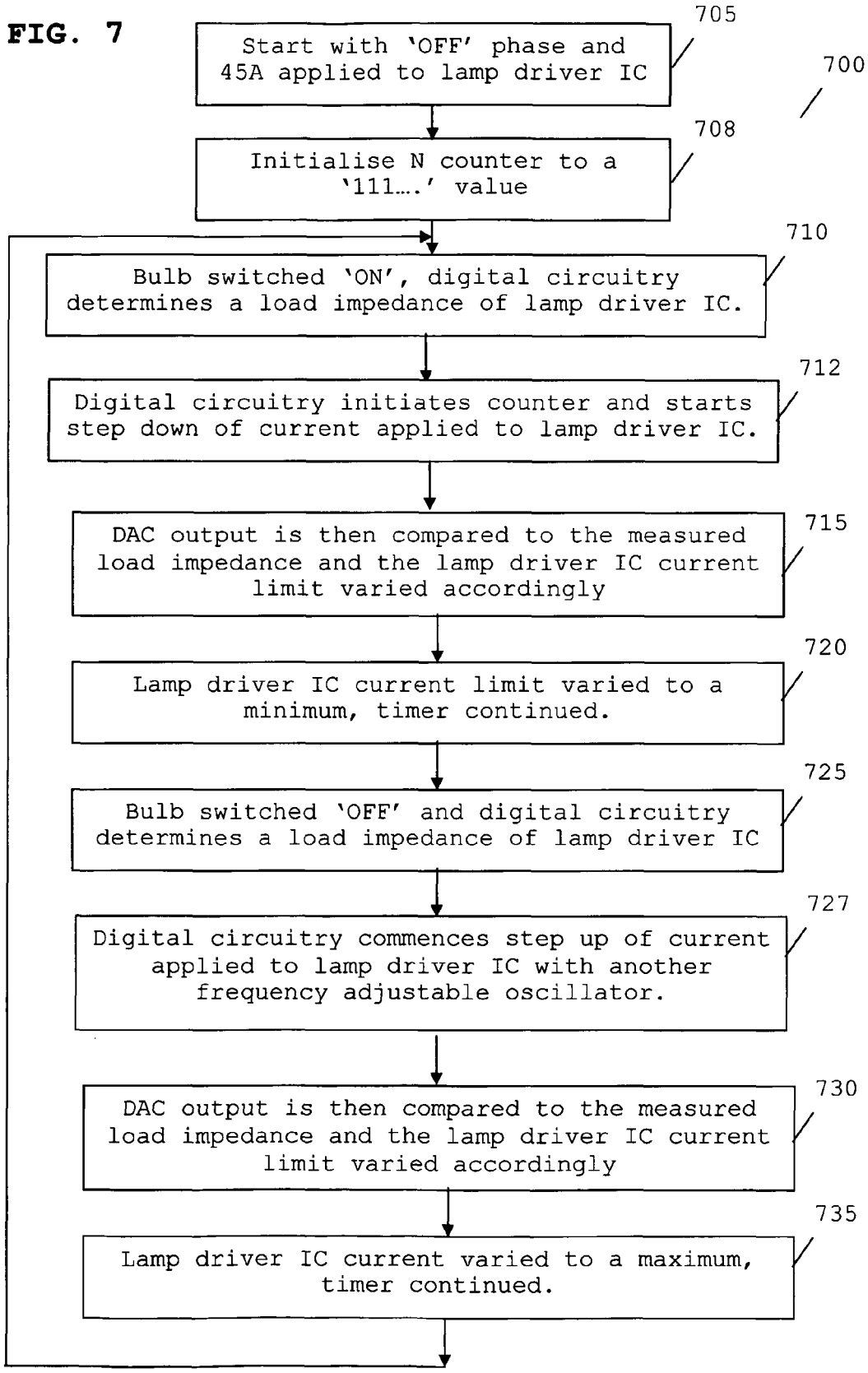

Exemplary embodiments of the present invention will now be described, by way of example only, with reference to the accompanying drawings, in which:

FIG. 3 illustrates a lamp driver and bulb arrangement, adapted in accordance with the preferred embodiment of the present invention;

FIG. 4 illustrates a more detailed lamp driver and bulb arrangement, adapted in accordance with the preferred embodiment of the present invention;

FIG. 5 and FIG. 6 illustrate graphically an operation of a lamp driver circuit and bulb, with regard to current requirements over time, in accordance with the preferred embodiment of the present invention; and FIG. 7 illustrates a method of operation of a lamp driver circuit and bulb, adapted in accordance with the preferred embodiment of the present invention.

DESCRIPTION OF PREFERRED EMBODIMENTS

The preferred embodiment of the present invention will be described in terms of a lamp driver and bulb arrangement. However, it will be appreciated by a skilled artisan that the inventive concept herein described may be embodied in any type of current driver employing a current limit where the normal load current is varying with time. In a number of applications, the adaptation of a driver circuit in accordance with the preferred embodiment of the present invention effectively performs a function of a fuse, in that it limits an average current being supplied to a current consuming device. In this manner, as the improved driver circuit emulates an operation of a fuse, there is no need for the circuit to comprise a fuse or associated wire connecting to/from the fuse, which is simple, destructive and unintelligent protection mechanism.

Furthermore, it is envisaged that the inventive concept is not limited to use in high-current applications. It is envisaged that the inventive concept herein described may equally be applied to low power device applications, for example where an IC drives a small bulb, of say 1 W, using a small motor or coil driver.

In summary, the inventors of the present invention have both recognised and appreciated that, in practice, the required 'inrush' current to support a lamp driver and bulb arrangement is dependent upon whether the bulb that is being driven is 'cold' or 'hot', e.g. a temperature state of the bulb. Hence, a mechanism for adjusting the current limitation depending upon whether the lamp is, or has recently been, in an 'ON' or 'OFF' phase is described.

The preferred embodiment of the present invention aims to adjust the current limit imposed on the lamp driver IC over time, to reflect the temperature change of the bulb's filament as it heats up or cools down. Preferably, this adjustment is based on the change of the load impedance over time, which is substantially equivalent to a temperature change.

Referring now to FIG. 3, a lamp driver 300 and bulb 325 arrangement is illustrated that has been adapted in accordance with the preferred embodiment of the present invention. The lamp driver 300 and bulb 325 arrangement comprises a lamp driver circuit 300 having a digital circuit 305 operably coupled to a lamp driver IC 320, which in turn is operably coupled to, and drives a current to, a light bulb 325. The digital circuit, in the preferred embodiment of the present invention, may comprise any digital circuitry, for example any circuitry from a few digital logic gates up to a microcontroller-based arrangement.

The digital circuitry 305 is also operably coupled to a counter 315 and a load impedance measuring function 310. One example of a load impedance measuring function is a temperature sensor. The load impedance measuring function is also operably coupled to the light bulb 325 for determining an input load impedance of the bulb 325.

It is within the contemplation of the present invention that one or more of the functional blocks in FIG. 3 (apart from the bulb 325) may be located either within, or operably coupled to, the lamp driver IC 300, dependent upon design choice and/or the application.

In accordance with the preferred embodiment of the present invention, the load impedance of the light bulb 325 is tracked over time, for example using a temperature sensor or a dedicated algorithm (as described with respect to FIG. 4 or FIG. 7) to determine the input impedance of the current consuming device, such as light bulb 325, as seen by the current driver. In the preferred embodiment, it is proposed to monitor load impedance over time and compare the impedance with a load impedance threshold, where the threshold is set based on a previously-determined load impedance value. The digital circuitry 305 then adjusts accordingly a current limit applied to the lamp driver IC 320.

When the lamp driver IC 320 is 'ON', the digital circuitry 305 controls the lamp driver IC 320 to apply a current to the light bulb 325 that heats up the bulb filament with a certain time constant. For example, after approximately 50 msec it may be assumed that the bulb filament is hot. During an 'OFF' phase, the bulb filament cools down according to another time constant, for example after approximately 10 seconds the bulb filament is cool.

Thus, a current driver circuit 300, which in the preferred embodiment is a lamp driver IC, comprises a digital circuitry 305 having a current adjustment function 335. The current adjustment function 335 may be implemented using any known technique, as illustrated with respect to FIG. 4. The current adjustment function 335 is operably coupled to the current driver 320 for providing a current to a current consuming device, such as a light bulb 325. Notably, the digital circuitry 305 comprises, or is operably coupled to, a function 340 arranged to determine a load impedance associated with the current consuming device. One embodiment of the present invention uses a temperature sensor as the function 340. In this manner, the temperature sensor measures a temperature of the bulb, which equates to load impedance associated with the bulb.

In accordance with the preferred embodiment of the present invention, and in response to a variable load impedance, the current adjustment function 335 varies a current limit applied to the current driver 320.

A skilled artisan will appreciate that in other applications, alternative functions/circuits/devices and/or other techniques may be used for monitoring load impedance; a preferred example being illustrated below with respect to FIG. 4.

In accordance with the preferred embodiment of the present invention, the current limit is adapted by decreasing or increasing it with a certain time constant (i.e. slope), as described below with respect to the graphs illustrated in FIG. 5 and FIG. 6.

It is envisaged that the particular time constant (slope) applied to the lamp driver IC may depend on a predetermined characterisation of load, for example as monitored or measured during laboratory testing or manufacture.

It also envisaged that the particular time constant (slope) may be adjusted by the digital circuitry 305 via an SPI 330. In this manner, the particular time constant (slope) may be adjusted to fit different types of loads.

It is envisaged that the Digital circuitry 305 comprises, or is operably coupled to, a digital or analogue integrator (not shown) to evaluate the load impedance of (and therefore the current applied to) the bulb at any particular instant in time. A measured time elapse since a previous turn 'ON' or 'OFF' of the bulb filament is also preferably factored in, taking into account that it takes approximately 50 msec to heat the bulb from cold, and approximately '5' seconds for the bulb filament to cool down from hot.

In the preferred embodiment of the present invention, the digital counter 315 is used to track how long the lamp bulb has been in an 'ON' phase or an 'OFF' phase. In this manner, the Digital circuitry 305, following receipt of timing updates from the digital counter 315, is configured to control/vary the current limit applied to the lamp driver IC 320 to reflect further temperature increases or decreases as the light bulb 325 heats up or cools down. For example, it is envisaged that the digital counter 315 is configured to 'step up' in a series of small current levels during an 'OFF' phase and 'step down' during an 'ON' phase.

Thus, in summary, the preferred embodiment of the present invention applies a current limit that follows the load impedance (equating to the bulb filament temperature) integrated over time. Notably, the variation of the current limit is applied during an 'OFF' phase, as well as during an 'ON' phase. Furthermore, and advantageously, the variation of the current limit is applied over multiple 'ON'/'OFF' cycles.

During the 'ON' phase, the bulb filament is heating up and therefore the current limit is decreasing with a specific temperature coefficient. As an example, a 21 W/12V bulb will reach a DC current of 2 A after a maximum of 80 msec's. During the 'OFF' phase, the bulb filament is cooling down. The inrush current at the next turn 'ON' is increasing (i.e. the impedance is decreasing) up to a nominal inrush current (when the bulb is cold).

A skilled artisan will appreciate that a second temperature coefficient will fit this temperature decrease rate. Thus, a first temperature co-efficient (or algorithm or time constant) is applied by the Digital circuitry 305 during an 'ON' heating phase, and a second temperature co-efficient (or algorithm or time constant) is applied by the Digital circuitry 305 during an 'OFF' cooling down phase.

Advantageously, if the lamp driver IC 320 is turned 'ON' again, after a short 'OFF' period (for example, of the order of less than one second), the current limit applied by the Digital circuitry 305 will be configured to stay at a lower value. Advantageously, in this manner, the digital circuitry provides better protection to the system IC 320, for example in the case of any short circuit.

In an enhanced embodiment of the present invention, it is envisaged that the inventive concept can by applied with a pulse width modulation (PWM) scheme. In a PWM context, the current limit is regulated dependent upon the PWM ratio, i.e. current limit is adjusted dependent upon a PWM duty cycle. Notably, the current limits that are applied are at a much lower level than the nominal in-rush current. The PWM mode of operation applied to the lamp driver IC 320 is performed by the Digital circuitry 305. In alternative embodiments, it is envisaged that the PWM mode of operation may be implemented internally within the lamp driver IC 320, when coupled to (or comprising), say, a clock/timing base and configured with a PWM ratio that can be pre-determined or varying.

It is also envisaged that this enhanced embodiment may be applied to a motor driver employing PWM, where a 'stopped' motor may be considered equivalent to a 'cold bulb' and a running motor may be considered equivalent to a 'hot bulb'. In this context, both 'ON' phase and 'OFF' phase temperature co-efficient rules are preferably adjusted dependent upon the motor and/or bulb type.

Alternatively, it is envisaged that the temperature co-efficient rules may be adjusted after the load is characterised, for example in the laboratory or during manufacture. In a further enhanced embodiment of the present invention, it is envisaged that the temperature rules may be updated through continuous or intermittent monitoring of the impedance load (or temperature) of the bulb, as its performance varies, say, through ageing.

Furthermore, it is envisaged that a customer or user of the lamp driver IC, is provided with the means to adapt the temperature rules/timing constant (or slope) in response to any change in the type of load applied. Thus, the performance of the lamp driver IC is configured as re-programmable.

Referring now to FIG. 4, a more detailed current driver circuit 400 is illustrated. Programming 405 and calibration 410 information is provided to a first frequency adjustable oscillator circuit 415, for adjusting the PWM frequency of operation during an 'OFF' phase. An output of the frequency adjustable oscillator circuit 415 is input to a first logic 'AND' gate 450.

If a PWM-based system 420 is employed, the PWM output signal is applied to a second logic 'AND' gate 455. A fault detection signal 425 is also inverted and applied to the second logic 'AND' gate 455. An 'ON'/'OFF' command signal 430 is also applied to the second logic 'AND' gate 455.

Programming 405 and calibration 410 information is also provided to a second frequency adjustable oscillator circuit 445, for adjusting the PWM frequency of operation during an 'ON' phase. An output of the second frequency adjustable oscillator circuit 445 is input to a third logic 'AND' gate 460.

The second logic 'AND' gate 455, has an output that is input to a first logic 'AND' gate 450 and inverted and input to the third logic 'AND' gate 460. Outputs from the first and third logic gates are input to an 'N'-bit counter 465. The first logic 'AND' gate 450 is used to increase the counter, up to '1111 . . . ', with the third logic 'AND' gate 460 used to decrease the counter down to '0000 . . . '.

Dependent upon whether the current consumption device is in an 'ON' or 'OFF' state, the 'N'-bit counter is increased or decreased, with a digital output signal consequently increased or decreased and input to a digital-to-analog converter (DAC) 470. At a high output, equating to an 'N'-bit converter output of '1111 . . . ', the output from the DAC 470 is equivalent to the peak-current limit. At a low output, equating to an 'N'-bit converter output of '0000 . . . ', the output from the DAC 470 is equivalent to the dc-current limit.

The output from the DAC 470 is a 'threshold' input to a comparator 475, which performs the detection of the load current (or voltage) and comparison of this threshold with the real-time value of load current (or voltage) provided by the load monitoring function 480. The load monitoring function 480, which may be configured to operate with load current or load voltage output signals, is also input to an input of the second frequency adjustable oscillator 445. In the context of the present invention, the load monitoring function 480 is, for example, a signal processor that measures the current in real-time and then provides a control signal to the frequency adjustable oscillator.

In the preferred embodiment of the present invention, the varying of the current limit encompasses varying the threshold level that is the output from the DAC 470. In effect, the 'current' limit equates to an overload limit relating to the load impedance, which is varying. This overload limit is thus compared to the actual load impedance measured in real-time. In this manner, if the output from the comparator is input to a processing function (not shown), a fault can be detected in function 425, which may then be used to adjust the current limit.

Advantageously, in accordance with an enhanced embodiment of the present invention, the output from the load monitoring function 480 to the second frequency adjustable oscillator 445 may be used to adjust (increase or decrease) the rate of the slope being used to adapt the current limit value during an 'ON' phase. Preferably, the adjustment of the slope (in FIG. 5 or FIG. 6) is made dependent upon the current being drawn. The adjustment of the slope is then applied to vary the output of the oscillator frequency.

In this enhanced embodiment, it is envisaged that the particular time constant (slope) may be adjusted dependent upon the current actually flowing into the lamp driver IC, as illustrated in the graphs of FIG. 5 and FIG. 6. This enhanced embodiment of adjusting the slope dependent upon the current being drawn by the current consumption device, may be employed in combination with the preferred embodiment of adjusting the current limit applied to the current consumption device. Thus, instead of applying a constant decreasing slope to decrease the current limit applied during an 'ON' phase, a variable rate decreasing slope may be used. Hence, during an 'ON' phase, the current being applied is also measured and used to vary the oscillator frequency.

During an 'OFF' phase, there is no current being drawn, so the load impedance is not affected. Thus, a load impedance determination of the preferred embodiment is solely used in this context.

The output of the comparator is input to an optional filter 485, which may be included to remove any glitches or parasitic interference in the comparator output signal, which is effectively a current adjusted signal 490 applied to the current consumption device.

Although the preferred embodiment of the present invention is described in terms of 'overload' current, it is envisaged that the inventive concept is equally applicable to overload voltage values.

In this manner, a determination of load impedance of a current consuming device (such as a light bulb) is made and compared to a threshold value equivalent to a known previous 'load impedance'.

The circuitry illustrated in FIG. 4 is applicable for a digital system for, say a lamp driver or motor-based embodiment. It is envisaged that a similar circuit can be used for inductive (coil)-based arrangement, with some functions inverted (such as the configuration of the high-end and low-end counter values of the 'N'-bit counter, as would be appreciated by a skilled artisan). It is also envisaged that the digital circuitry can be replaced by analogue circuitry and utilise the inventive concept hereinbefore described.

Referring now to FIG. 5, an operation of a lamp driver circuit and bulb is illustrated graphically 500, where the current limit is continuously stepped down over time during an 'ON' phase, in accordance with the preferred embodiment of the present invention. A time counter 510 is illustrated, with a corresponding current limit 515 that is stepped down in 5 A steps by, say, the digital circuitry 305 of FIG. 3.

As clearly shown, when comparing the varying current limit approach described herein with the non-varying current limit approach illustrated in FIG. 2, a significant saving in current is achieved, thereby improving the protection and life span of the lamp driver IC.

Similarly, an alternative varying current limit approach is illustrated in graph 505. For example, this alternative varying current limit approach may be aligned to a PWM ratio of approximately 300 Hz, with a 10 A step down.

Referring now to FIG. 5, an operation of a lamp driver circuit and bulb is illustrated graphically 500, where the current limit is stepped down over time during an 'ON' phase, in accordance with the preferred embodiment of the present invention. As described above, a counter is incremented, with a corresponding current limit that is stepped down in 5 A steps 515 or stepped down in 10 A steps 505 by, say, the digital circuitry 305 of FIG. 3. Alternatively, the current limit is continuously adjusted 510.

Again, when comparing the varying current limit approach described herein with a comparable non-varying current limit approach, a significant saving in current is achieved, thereby improving the protection and longevity of the lamp driver IC.

Similarly, an alternative varying current limit approach is illustrated in graph 605 of FIG. 6. Referring now to FIG. 6, an operation of a lamp driver circuit and bulb is illustrated graphically 600, where the current limit is stepped up over time during an 'OFF' phase, in accordance with the preferred embodiment of the present invention.

A counter operation 610 is illustrated, with a corresponding current limit 615 that is stepped up in 5 A steps or stepped up in 10 A steps 605 by, say, the digital circuitry 305 of FIG. 3. Alternatively, the current limit is continuously adjusted 610.

Again, when comparing the varying current limit approach described herein with a comparable non-varying current limit approach, a significant saving in current is achieved, thereby improving the protection and life span of the lamp driver IC.

Notably, with respect to FIG. 5 and FIG. 6, on entering an 'ON' or 'OFF' phase, the current adjustment commences from a particular current level and continues to increase or decrease until the current reaches a limit and the curve is horizontal. With respect to both the 'ON' and 'OFF' phase curves, the curves are arranged to be above the diagonal to ensure that the current driver is able to drive the load, especially in the case of high frequency PWM. For example, with a system that only has two or three bits, respectively high steps have to be made in order to drive the load. Thus, it is preferred to have a high number of bits to be used in implementing the DAC output.

For example, if a PWM rate of around 300 Hz is used, i.e. 3 KHz with a 10% accuracy and a period of five seconds to cool down the bulb, a fifteen bit DAC is required.

Referring now to FIG. 7, a flowchart 700 illustrates a preferred method of varying the current limit applied to a lamp driver IC. The method starts in an 'OFF' phase, with, say, a 45 A current being applied to the lamp driver IC by the Digital circuitry, as shown in step 705. The N-counter is initialised to a value of, preferably, '111 . . . ', upon turn-'ON', as shown in step 708. A light bulb is switched 'ON' in step 710, in response to which the digital circuitry determines a load impedance of the lamp driver IC. The determined load impedance is then applied to a logic gate with calibration data, and potentially a PWM scheme. The digital circuitry then initiates the counter and commences an algorithm to step down the current limit applied to the lamp driver IC, as shown in step 712, in response to a number of factors including the determined load impedance.

The DAC output is then compared to a measured load impedance and the lamp driver IC current limit varied accordingly, as shown in step 715. The lamp driver IC's current limit is consequently reduced to a minimum, via the counter outputting a series of values to a DAC, in step 720.

Subsequently, the bulb is switched 'OFF', with the digital circuitry determining a load impedance of the lamp driver IC, as shown in step 725. The determined load impedance is then applied to a logic gate with calibration data, and potentially a PWM scheme. The digital circuitry then commences an algorithm to step up (instead of step down) from the counter value, and therefore the current limit applied to the lamp driver IC, with another frequency adjustable oscillator, as shown in step 727, in response to a number of factors including the determined load impedance.

The DAC output is then compared to a measured load impedance and the lamp driver IC current limit varied accordingly, as shown in step 730. The lamp driver IC's current limit is consequently reduced to a minimum, via the counter outputting a series of values to a DAC.

The lamp driver IC current limit is subsequently varied to a maximum in step 735, with the monitoring of the load impedance continued. The process then loops back to step 710.

As mentioned, it is also envisaged that the inventive concept can be applied to a motor or a coil-based design. For a motor or coil-based design, the approach is inverted, in that the current limit is increasing during an 'ON' phase and decreasing during an 'OFF' phase. Here, current is typically carried by a re-circulation diode during the 'OFF' phase, whereas no current flows through the main current driver IC. Thus, there is no power dissipation in the main current driver IC and it is not prone to destruction.

Although the preferred embodiment of the present invention has been described with reference to low frequency signals, it is envisaged that, for alternative applications, the inventive concept may be applied to high frequency operation, such as applications operating in the MHz or GHz ranges.

It will be understood that the improved current driver circuit, such as a lamp driver and bulb arrangement, and method of operation therefor, as described above, aims to provide at least one or more of the following advantages:

(i) The circuit "knows" the load impedance (temperature) and is capable of continuously or intermittently adjusting the current limit to minimize the energy dissipated;

(ii) Inexpensive, if implemented with high integration technology;

(iii) The adapted current driver circuit performs a fuse emulator function, which limits energy entering the current driver and protects the wire between the lamp driver and bulb; and (iv) Reduces the potential energy dissipated during test with a cyclic short circuit, for example, a permanent or erratic short circuit with repetitive turn-'ON', at a low or high frequency.

In particular, it is envisaged that the aforementioned inventive concept can be applied by a semiconductor manufacturer to any current driver, such as a lamp driver or motor driver or coil-based driver and bulb arrangement, for example those of the Freescale™ Switch family. Furthermore, the inventive concept can be applied to any circuits, for example where the digital area of the silicon is very small, such as the Smart metal oxide semiconductor (SMOS) SMOS8 MV™ as manufactured by Freescale™ Semiconductor. It is further envisaged that, for example, a semiconductor manufacturer may employ the inventive concept in a design of a stand-alone device, such as a lamp driver integrated circuit, or application-specific integrated circuit (ASIC) and/or any other subsystem element.

Whilst the specific and preferred implementations of the embodiments of the present invention are described above, it is clear that one skilled in the art could readily apply variations and modifications of such inventive concepts.

Thus, an improved current driver, such as a lamp driver IC, and current consuming device, such as a light bulb, arrangement and method of operation therefor have been described, wherein the aforementioned disadvantages with prior art arrangements have been substantially alleviated.

The invention claimed is:

1. A device comprising:

a module comprising an output operable to provide a first signal indicative of a load current or a load voltage associated with a current consuming device;

first circuitry comprising:

an input operable to receive a second signal indicative of a variation of a load impedance associated with the current consuming device during an "ON" phase and an "OFF" phase of the current consuming device and an output operable to provide a over-load limit signal based on the second load signal; and a comparator comprising a first input coupled to the output of the module, a second input coupled to the output of the first circuitry, and an output coupled to a current driver operable to provide a current to the current consuming device based on a comparison of the first load signal to the over-load limit signal.

2. The device of claim 1, further comprising second circuitry comprising an input to receive the first signal and an output coupled to the input of the first circuitry, the second circuitry operable to determine the load impedance based upon the first signal provide the second signal based on the first signal, and to provide the signal indicative of the variation of the load impedance at its output.

3. The device of claim 2, wherein the first circuitry comprises a digital-to-analogue converter.

4. The device of claim 3, wherein the second circuitry comprises:

a first frequency adjustable oscillator operable to provide an output signal having a pulse-width based on an amount of time the current consuming device is in the "OFF" phase; and a counter comprising a first input coupled to the output of the first frequency adjustable oscillator and an output coupled to the input of the digital-to-analogue converter.

5. The device of claim 4, wherein the second circuitry further comprising:

a second frequency adjustable oscillator comprising an input coupled to the output of the module and an output operable to provide an output signal having a pulse-width based on an amount of time the current consuming device is in the "ON" phase; and wherein the counter comprises a second input coupled to the output of the second frequency adjustable oscillator.

6. The device of claim 2, wherein the output of the comparator is operable to control a lamp driver signal for driving a light emitting current consuming device.

7. The device of claim 6, wherein the second circuitry is operable to determine the load impedance based on a temperature of the light emitting current consuming device.

8. The device of claim 6, wherein the second circuitry is operable to determine the load impedance based on a variation in temperature of the light emitting current consuming device.

9. The device of claim 6, wherein the second circuitry comprises an integrator comprising an output operable to provide a signal indicative of a bulb filament temperature, the second circuitry operable to adjust the second signal based on the output of the integrator.

10. The device of claim 9, wherein the integrator is a digital integrator.

11. The device of claim 2, wherein the output of the comparator is operable to control a motor driver signal for driving a light emitting current consuming device.

12. The device of claim 2, wherein the second circuitry is operable to adjust the second signal by continuously monitoring the load impedance associated with the current consuming device.

13. The device of claim 2, wherein the second circuitry is operable to adjust the second signal by intermittently monitoring the load impedance associated with the current consuming device.

14. The device of claim 1, wherein the first signal is indicative of a load current.

15. The device of claim 1, wherein the first signal is indicative of a load voltage.

* * * * *